US006244360B1

(12) United States Patent
Steinsland

(10) Patent No.: US 6,244,360 B1
(45) Date of Patent: Jun. 12, 2001

(54) APPARATUS AND METHOD FOR RUNNING TUBULARS

(75) Inventor: Nils Steinsland, Sandnes (NO)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/297,015

(22) PCT Filed: Oct. 29, 1997

(86) PCT No.: PCT/GB97/02821

§ 371 Date: Apr. 23, 1999

§ 102(e) Date: Apr. 23, 1999

(87) PCT Pub. No.: WO98/19039

PCT Pub. Date: May 7, 1998

(30) Foreign Application Priority Data

Oct. 29, 1996 (GB) ..... 9622480

(51) Int. Cl.[7] ..... E21B 19/00
(52) U.S. Cl. ..... 175/52; 175/85
(58) Field of Search ..... 175/52, 85; 166/77.51, 166/77.52, 77.53, 380, 381; 414/22.51, 22.63, 22.65, 22.66, 22.54, 22.55, 22.57, 22.71

(56) References Cited

U.S. PATENT DOCUMENTS

| | | | | |
|---|---|---|---|---|
| 2,113,270 | | 4/1938 | Hall et al. . | |
| 2,900,091 | | 8/1959 | Minter | 214/2.5 |
| 2,946,464 | | 7/1960 | Guier . | |
| 2,972,388 | * | 2/1961 | Thornburg | 175/52 |
| 3,157,286 | | 11/1964 | Gyongyosi . | |
| 3,212,593 | | 10/1965 | Reischl . | |
| 3,286,777 | | 11/1966 | Gyongyosi . | |
| 3,336,991 | | 8/1967 | Klem et al. | 214/2.5 X |
| 3,780,883 | | 12/1973 | Brown | 214/2.5 |
| 3,913,753 | | 10/1975 | Swartz et al. | 214/2.5 |
| 4,455,116 | * | 6/1984 | Lindstedt et al. | 175/52 |
| 4,708,563 | * | 11/1987 | Van Den Berg et al. | 175/52 |
| 4,892,160 | * | 1/1990 | Schivley, Jr. et al. | 175/52 |
| 5,297,642 | * | 3/1994 | Rajakallio et al. | 175/85 |
| 5,806,613 | | 9/1998 | Sparks et al. | 175/52 |

* cited by examiner

*Primary Examiner*—Thomas B. Will
*Assistant Examiner*—Nathan Mammen
(74) *Attorney, Agent, or Firm*—Guy McClung

(57) ABSTRACT

An apparatus for running a tubular. The apparatus is positioned in close proximity to a well center and comprises a base and a magazine. The magazine holds a plurality of tubulars and is rotatably mounted on the base. The magazine is reloaded in the proximity of the well center after a tubular has been dispensed therefrom.

20 Claims, 8 Drawing Sheets

FIG. 4
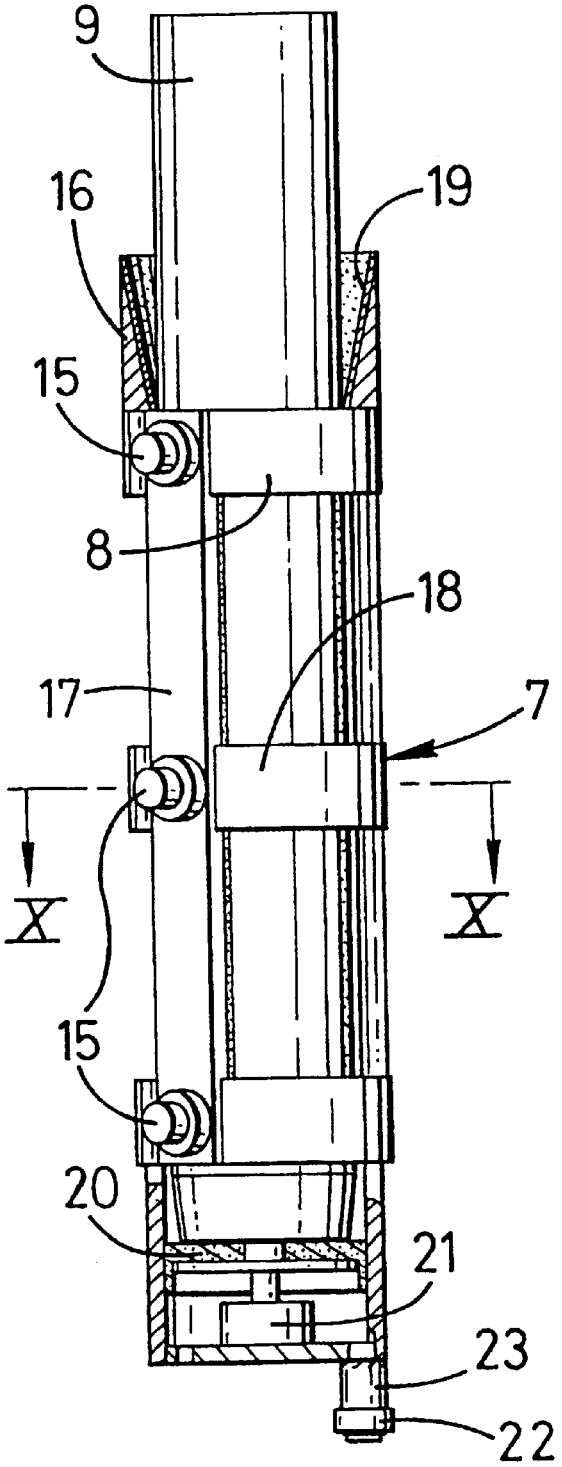
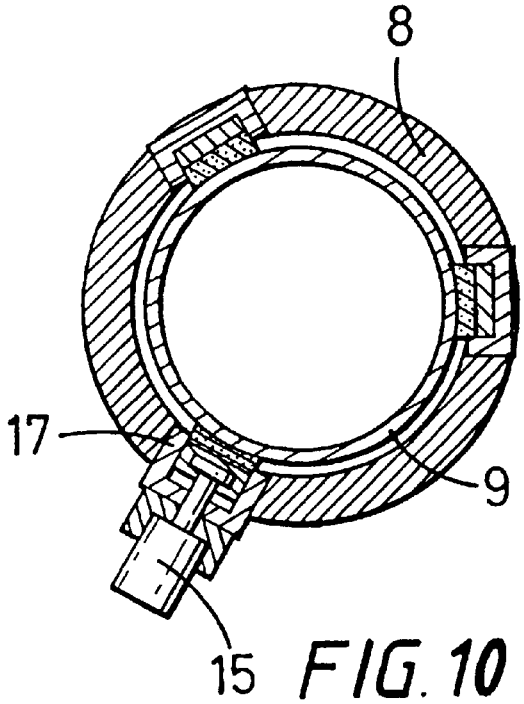
FIG. 10
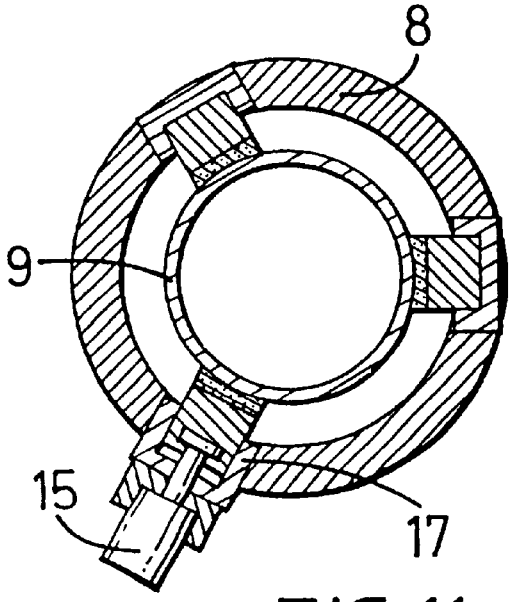
FIG. 11

APPARATUS AND METHOD FOR RUNNING TUBULARS

This invention relates to an apparatus and a method for running tubulars.

Because of the very high costs associated with the rental and running of drilling rigs more and more effort is being expended on finding ways to reduce the time consumed by each operation. The present invention is concerned with running tubulars, for example drill pipe, casing and work strings.

By way of example, during the construction of oil and gas wells a hole is drilled in the ground. Tubulars, known as casing, are then lowered down the hole and the annular space between the hole and the bore filled with cement.

Running casing typically involves raising the travelling block of a drilling rig to near its highest position, swinging a length of casing into position below the travelling block, attaching the travelling block to the casing and lowering the casing into the hole. When the travelling block reaches the bottom of its travel slips are applied to the casing to hold it in position. The travelling block is then disconnected from the casing, raised to near its highest position and a new length of casing manoeuvred into position, attached to the travelling block and screwed into the casing held in the slips. The travelling block is then raised slightly to lift the entire casing string and allow the slips to be released and then lowered until the travelling block reaches the lowest position whereafter the slips are applied and the process repeated.

By careful observation we have discovered that one of the major time delaying factors in running casing and other tubulars is caused by interruptions in the supply of tubulars to the travelling block. These delays tend to be caused by other work being carried out on the drilling rig and disrupting the operation of the normally efficient pipe handling equipment which transfers the tubulars from a V-slot and racks alongside the drilling rig to the well centre.

In order to help overcome this problem it has been proposed to provide a magazine in close proximity to the well centre. As disclosed in WO 84/01599 such magazines can hold up to 5760 m of pipe. The disadvantage of this arrangement is that the magazine is very large and heavy and can only be used on very large drilling platforms.

According to one aspect of the present invention there is provided an apparatus for running a tubular, which apparatus can be positioned in close proximity to a well centre and comprises a base and a magazine which can hold a plurality of tubulars and which is rotatably mounted on said base, characterised in that said magazine can be reloaded in the proximity of said well centre after a tubular has been dispensed therefrom.

The underlying concept is that the magazine will provide a reliable supply of tubulars which can be refilled by the conventional pipe handling equipment while the tubulars are being run. Short delays when the pipe handling equipment cannot be used do not affect the supply of the tubulars from the magazine which can be rapidly replenished when the pipe handling equipment is in normal use.

The magazine may be of any convenient shape, with circular being currently preferred.

The magazine may be designed to hold the tubulars substantially vertically. However, it may be preferred to design the magazine so that the tubulars can be angled outwardly so that they can readily be attached to the travelling block or an elevator if such is used to transfer the casing from the magazine to the travelling block. This is a particularly desirable feature.

In one embodiment the magazine is provided with separate and distinct containers each of which can accommodate a tubular and each of which can be independently pivoted. If desired, the entire magazine may be mounted for tilting movement about a vertical axis.

Preferably, said separate and distinct containers are each mounted on a carrier column which is rotatably mounted on said base.

Advantageously, said means can angle a tubular outwardly only when said tubular is in a certain position.

Preferably, said means is located in said base.

Advantageously, said means comprises a cylinder and a slide plate, the arrangement being such that upon movement of said cylinder in one sense said slide plate moves radially inwardly to pivot said container.

Preferably, said apparatus includes a guide plate for guiding said containers as said magazine is rotated.

Advantageously, said slide plate, in its radially outermost position is substantially aligned with said guide plate.

Preferably, said apparatus further comprises a safety ring.

Advantageously, said safety ring has a break therein which accommodates said slide plate upon contraction of said cylinder and inhibits rotation of said magazine relative to said base.

Preferably, said containers have means to accommodate tubulars of different diameters.

Advantageously, said means comprises one or more clamping bars movably mounted on the pistons of one or more hydraulic clamping cylinders.

Preferably, at least one of said containers is provided with a hydraulic cylinder which is connected to the hydraulic clamping cylinder(s) associated with said container, the arrangement being such that, in use, when a tubular bears on said hydraulic cylinder said clamping bar is urged against said tubular.

The present invention also provides a drilling rig having a drilling platform having a hole to allow casing to be lowered therethrough, characterised in that said drilling rig is provided with an apparatus in accordance with the present invention which is located proximate said hole.

Preferably, said drilling rig also includes a storage area for storing tubulars. The storage area may be above, below or at the same level as the drilling platform. However, in each case the magazine should lie between the point of transfer of the tubulars from the storage area and the hole.

It is highly preferable that the pipe handling equipment should be capable of supplying the casing to the magazine at a rate quicker than the magazine required to discharge the casing. However, even if this is not the case overall time savings can still be made by using routine delays in running the casing, for example for circulation if the casing becomes lodged, to fully recharge the magazine.

Another aspect of the present invention provides a method for running tubulars using an apparatus in accordance with the present invention, characterised in that said method comprises the steps of repeatedly dispensing tubulars from said magazine and replenishing said magazine whilst said apparatus remains in close proximity to said well centre.

In one embodiment said tubulars are dispensed to a string of tubulars being run into a wellbore.

In another embodiment said tubulars are dispensed to a tubular storage area.

For a better understanding of the present invention reference will now be made, by way of example, to the accompanying drawings in which:

FIG. 4 is a side view, partly in side elevation and partly in section, of a container which forms part of the apparatus shown in FIG. 2 holding a length of casing;

FIG. 10 is a section taken along line X—X of FIG. 4; and

FIG. 11 is a view similar to FIG. 10 but showing the arrangement holding a casing of smaller diameter.

Figure 1:
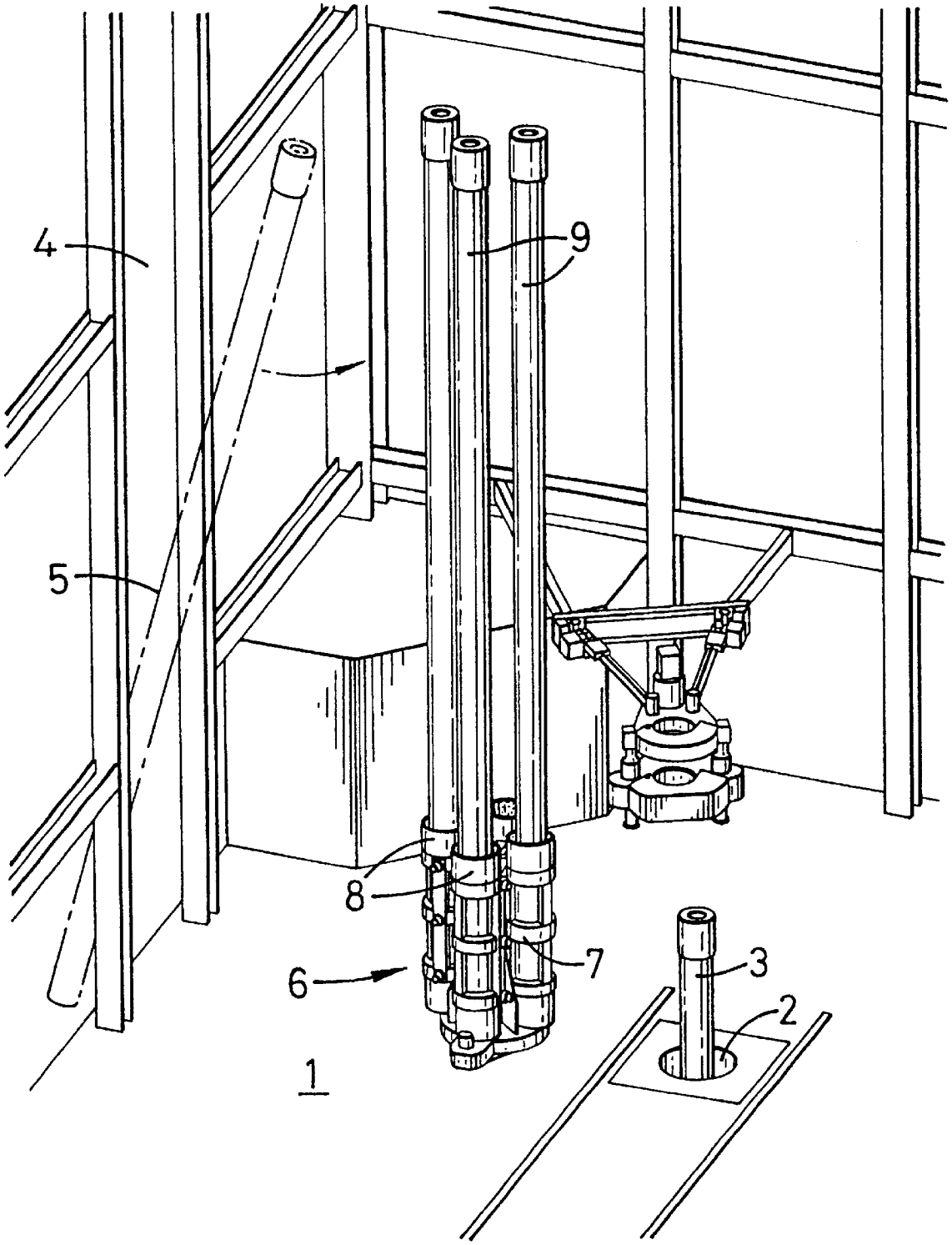
FIG. 1 is a perspective view of an apparatus in accordance with the present invention mounted on a drilling platform and in a first position.

Referring to FIG. 1 of the drawings there is shown a drilling platform which is generally identified by reference numeral 1. The drilling platform 1 is provided with a hole 2 (well centre) through which a length of casing 3 has been lowered from a travelling block (not shown).

Lengths of casing are stored in a storage area below the drilling platform 1 and are periodically raised through a "V-slot" 4. A length of casing 5 is shown been raised through the V-slot 4.

In a conventional drilling rig pipe handling equipment would be used to transfer the length of casing 5 directly over the hole 2 as and when required. In order for this to operate successfully a length of casing must always be available in the V-slot 4 when required.

The present invention differs from this arrangement insofar as an apparatus 6 is provided immediately adjacent the hole 2 and between the hole 2 and the V-slot 4. The apparatus 6 comprises a magazine 7 comprising a plurality of individual containers 8 each of which can accommodate a separate length of casing 9, three of which are shown in FIG. 1.

In operation the apparatus 6 is used to provide a reliable supply of casing to make-up the casing string whilst the pipe handling equipment (not shown) is used to transfer casing from the V-slot 4 to the apparatus 6 as and when required and as and when available.

Figure 2:
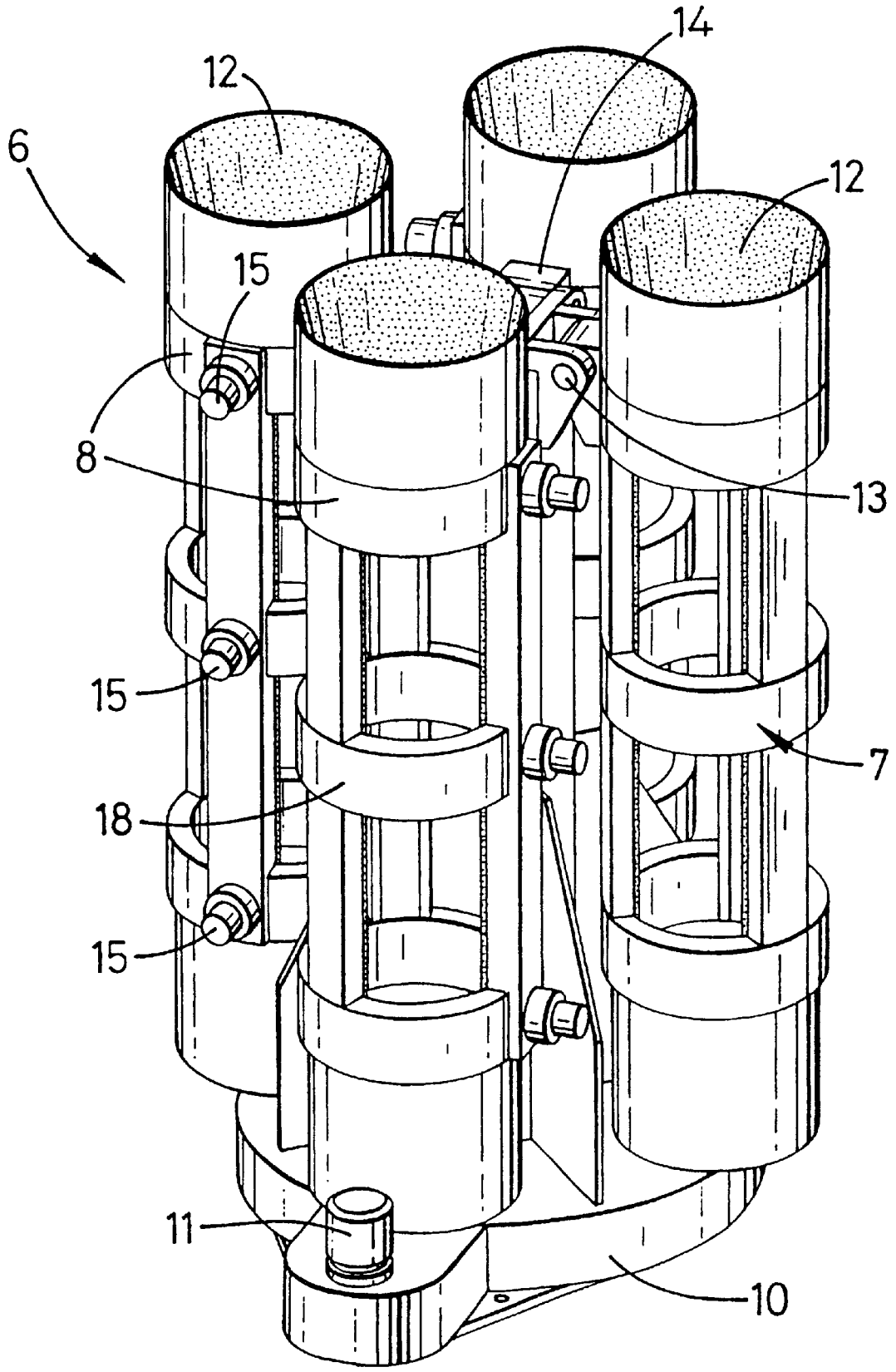
FIG. 2 is a perspective view, to an enlarged scale, of the apparatus shown in FIG. 1.
Figure 3:
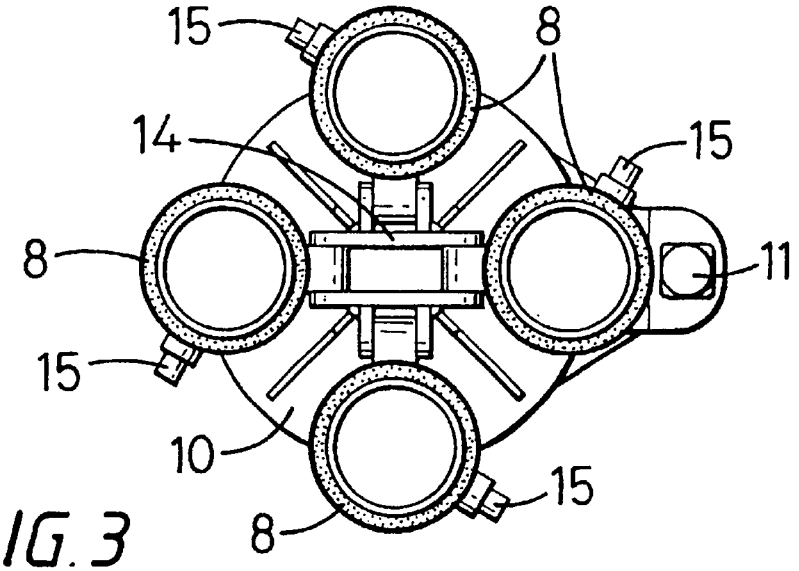
FIG. 3 is a top plan view of the apparatus shown in FIG. 2.
Figure 6:
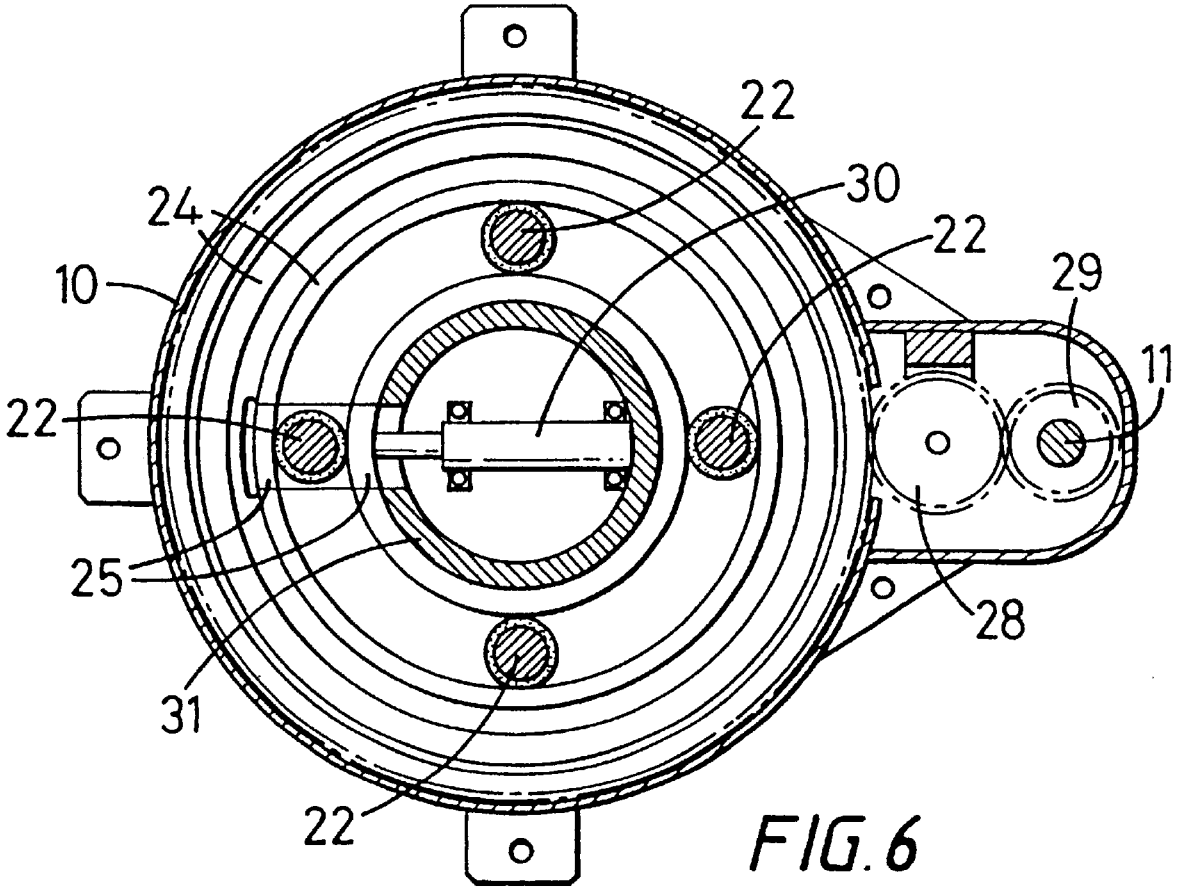
FIG. 6 is a section taken along line VI—VI of FIG. 5.

Referring to FIG. 2 and FIG. 3 the apparatus 6 Further comprises a base 10. The magazine 7 is rotatably mounted on the base 10 and is rotatable about its vertical axis by means of a hydraulic indexing motor 11. Each container 8, as part of the magazine 7, has a compartment 12 in which a length of casing 9 may be removably retained. Each container 8 is bolted via a bolt 13 to a carrier column 14. The magazine 7, in the preferred embodiment, comprises four containers B bolted to the carrier column 14 via bolts 13. Each container 8 has three hydraulic clamping cylinders 15 mounted thereon.

Figure 5:
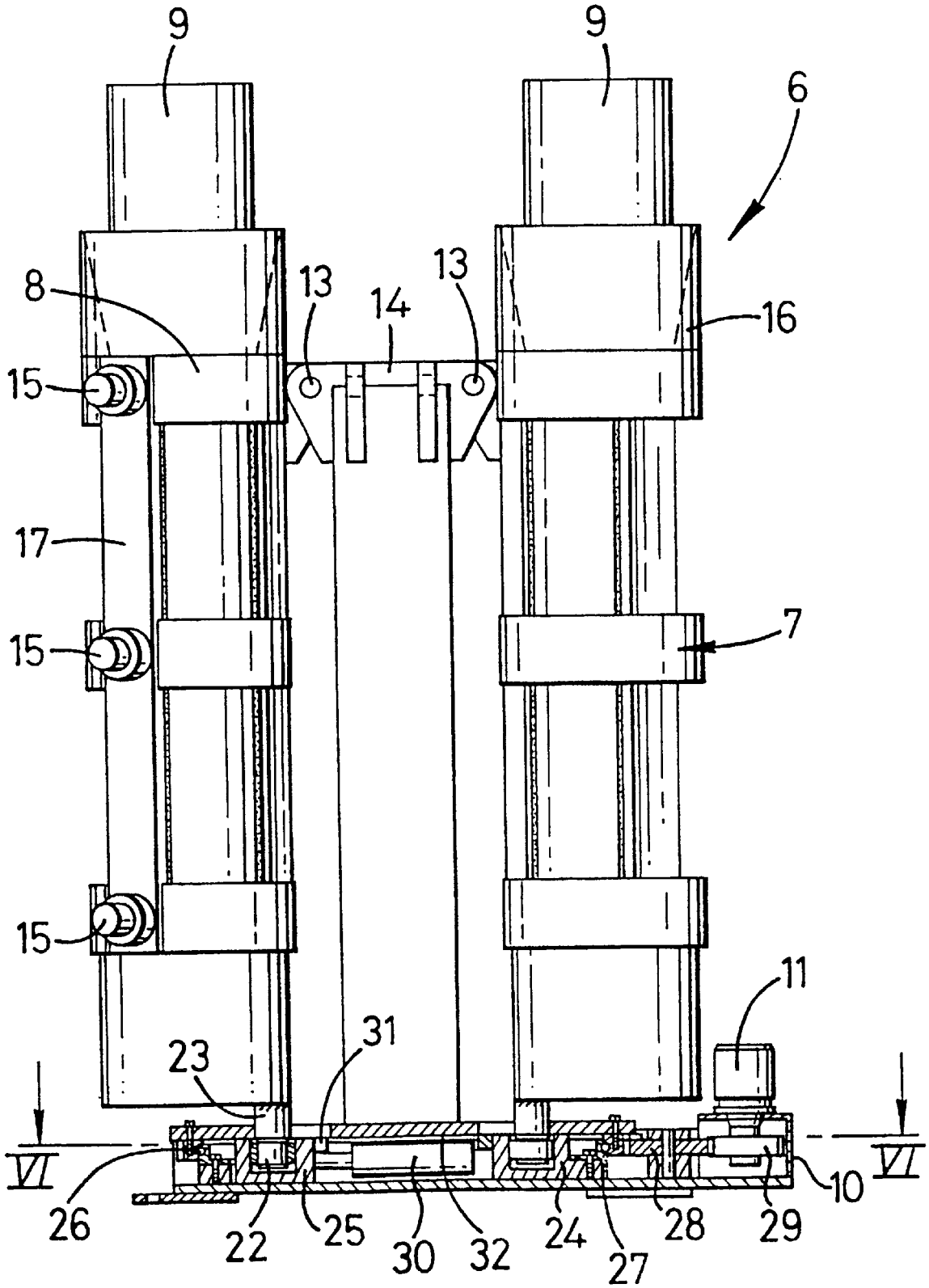
FIG. 5 is a view, partly in side elevation and partly in cross-section, of the apparatus shown in FIG. 2.
Figure 7:
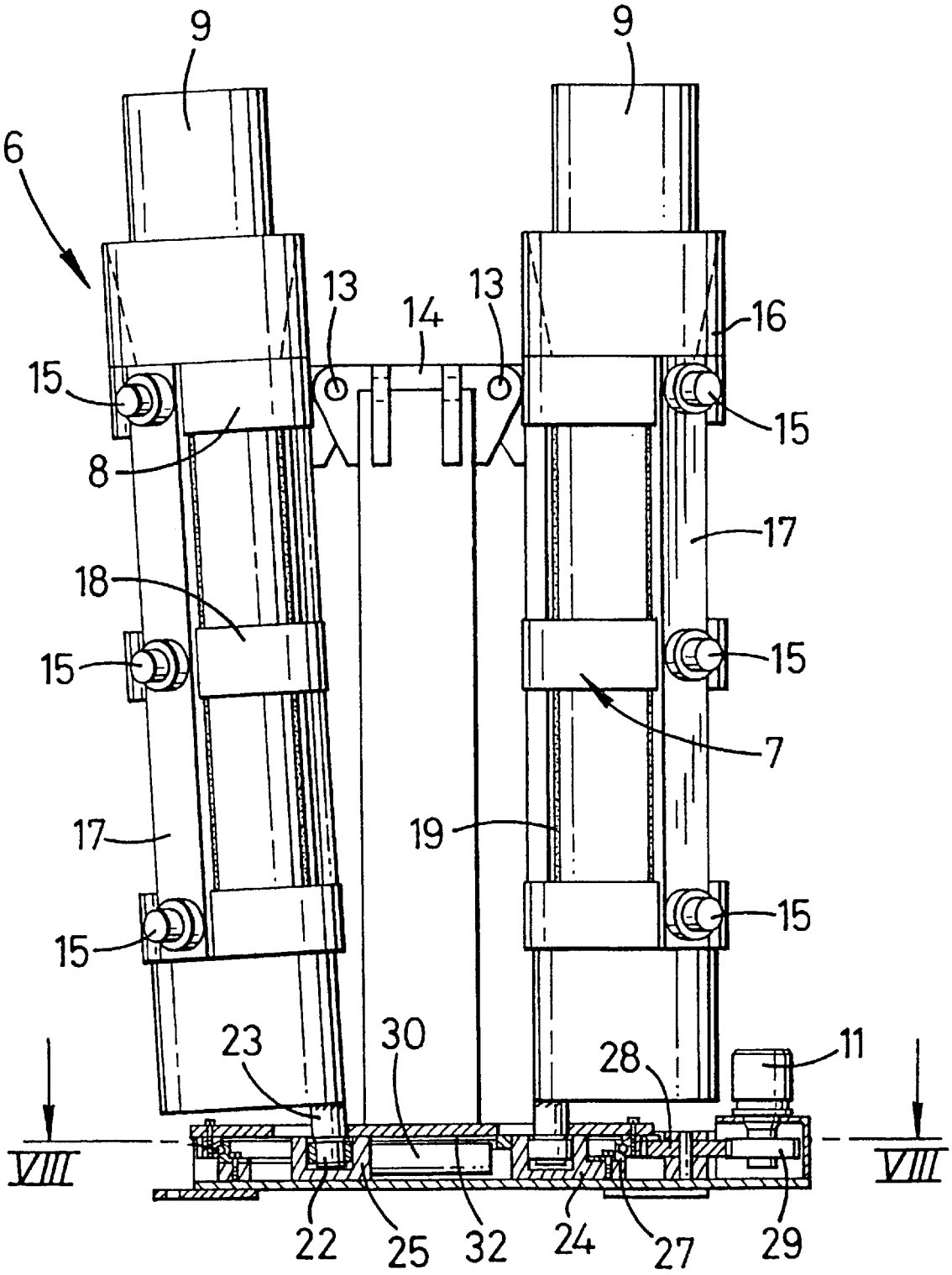
FIG. 7 is a view similar to FIG. 5 but showing the apparatus in a second position.
Figure 8:
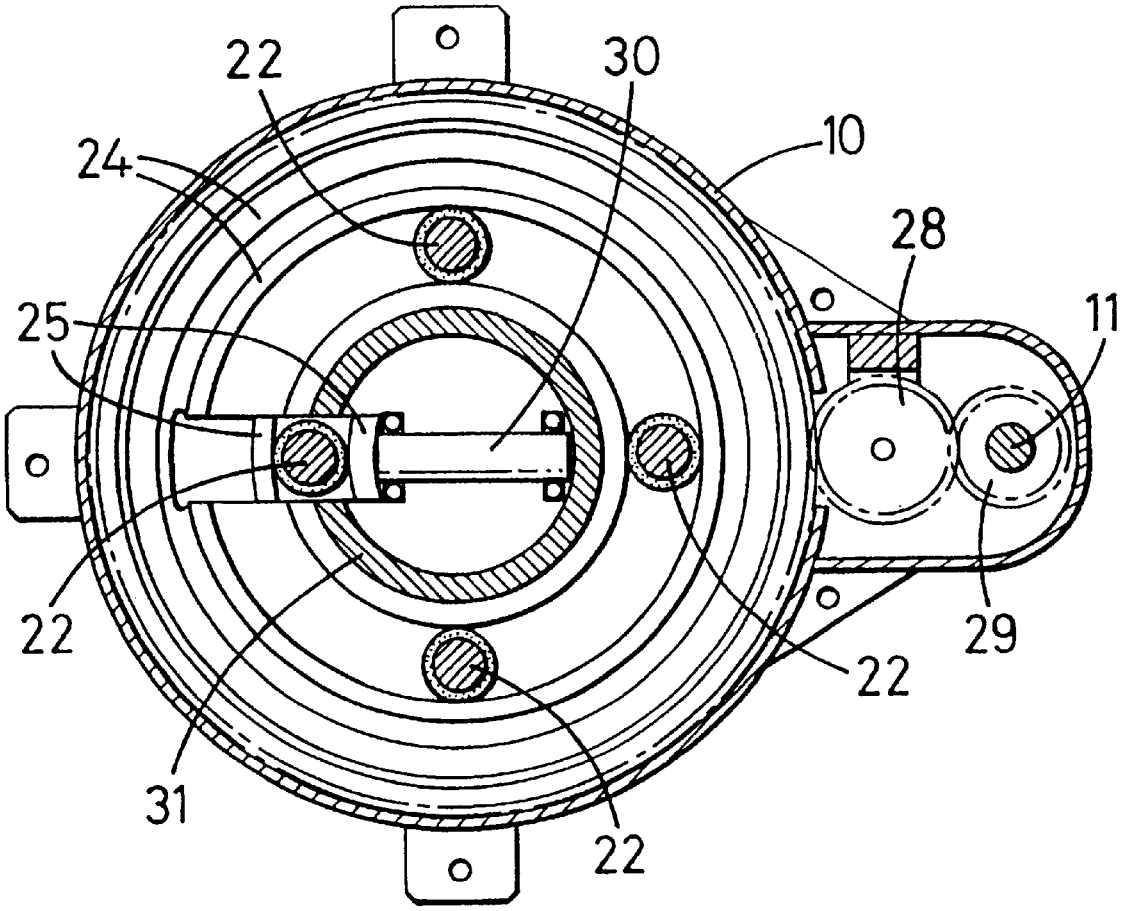
FIG. 8 is a section taken along line VIII—VIII of FIG. 7.
Figure 9:
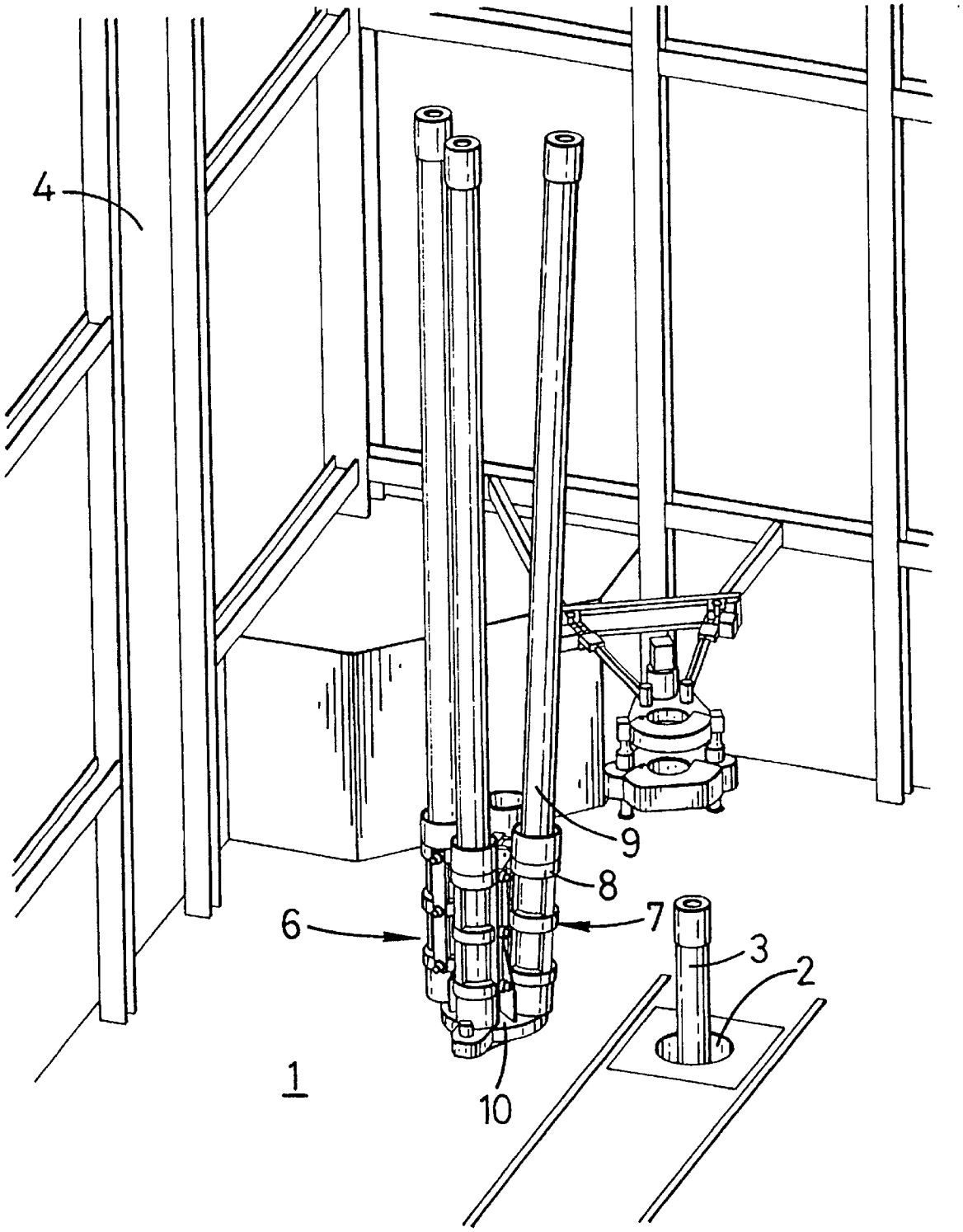
FIG. 9 is a view similar to FIG. 1 but showing the apparatus in its second position.

Referring to FIG. 4 and FIG. 5 the container 8 comprises a guide 16, a clamping bar 17 and a strap 18. A collar of elastomeric material 19 is attached to the guide 16 and a strip of elastomeric material is attached to the clamping bar 17. A cylinder of elastic material 20 is located substantially at the bottom of container 8 and is attached to a hydraulic cylinder 21, also within container 8. Hydraulic clamping cylinders 15 and hydraulic cylinder 21 are in fluid communication. The pistons of the hydraulic clamping cylinders 15 are connected to the clamping bar 17. An annular shaft extends below the container 8 and support a radial bearing 22. The container 8 is pivotally mounted at bolt 13.

In use, a length of casing 9 is introduced into the guide 16. The collar of elastomeric material 19 lining the guide 16 minimises any damage that may be caused by horizontal movement of the length of casing 9. As the length of casing 9 is inserted further into the container 8, added protection of the casing 9 is afforded by the strip of elastomeric material 19 attached to the clamping bar 17. Upon reaching the bottom end of the container 8 the end of the length of casing 19 abuts and is protected by the cylinder of elastomeric material 20 therein. Pressure created either by attempted further insertion of the length of casing 9 into the container 8, or by the weight of the casing 9, causes hydraulic cylinder 21 to be compressed. The hydraulic fluid displaced is applied to the hydraulic clamping cylinders 15 which exert a radially inward force on the clamping bar 17 and thus to the inserted end section of the length of casing 9. In combination the cylinder of elastomeric material 20 and the hydraulic cylinder 21 provide shock absorbing means to counter excessively fast or hard insertion of the length of casing 9 into the container 8 in order to protect the end of said casing 9.

The base 10 of the magazine 7 comprises: the hydraulic indexing motor 11, a guide plate 24, a slide plate 25, a ball bearing race 26, a non-rotating flange 27, an intermediate gear 28, a pinion 29, a tilting cylinder 30, a safety ring 31 and a rotor 32.

When rotated by the rotor 32 the annular shaft 23 and the radial bearing 22 are guided by the guide plate 24 which has a concentric groove (not shown). The containers 8 and the carrier column 14 with the rotor 32 are carried by the ball bearing race 26. The non-rotating flange 27 of ball bearing race 26 is fixed to the guide plate 24. The ball bearing race 26 engages with and is rotated by intermediate gear 28. The intermediate gear 28 is driven by pinion 29. The pinion 29 is driven by the hydraulic indexing motor 11.

Safety ring 31 subtends an angle of substantially 345 degrees. The longitudinal axis of the shaft of tilting cylinder 30 substantially bisects the remaining angle,the remaining angle being defined by slide plate 25. Slide plate 25 is radially movably mounted substantially parallel to the longitudinal axis of tilting cylinder 30.

Referring now to FIGS. 5, 6, 7, 8 and 9, the apparatus 6 is shown in both a first position (FIGS. 5 and 6) wherein the length of the casing 9 is in a substantially vertical position, and a second position (FIGS. 7, 8 and 9) wherein the length of casing 9 is in a tilted position.

In use, the apparatus 6 provides means to allow the length of casing 9 to be tilted. This means comprises tilting cylinder 30, slide plate 25, container 8, and bolt 13. The safety ring 31 defines the only position in which the length of casing 9 may be tilted. The length of casing 9 to be tilted is rotated into a position nearest the hole 2 via hydraulic indexing motor 11, as hereinbefore described, so that the radial bearing 22 of the container 8 holding the casing 9, is substantially opposite the end of the shaft of tilting cylinder 30 (see FIG. 6). To tilt the length of casing 9, the end of the shaft of tilting cylinder 30 is withdrawn radially from its position in abutment with slide plate 25. The turning moment of the length of casing 9 about bolt 13 will urge the radial bearing 22 and the slide plate 25 radially inwardly and thereby move the container 8 and the length of casing 9 into the second, tilted position (see FIGS. 7, 8 and 9). As soon as the radially inner edge of slide plate 25 moves inside the radially outer edge of safety ring 31 the rotor 32 is locked and prevents further rotation of magazine 7. The tilting angle is limited by the stroke of the tilting cylinder 30 or the radial width of annular shaft 23. The structure of the magazine 7 will also limit the tilting angle. For example, if the bolt 13 is situated further away from the tilting cylinder 30, the angle of tilt of the length of casing 9 is smaller for the same radial distance moved by the slide plate 25.

Once the length of casing 9 has been withdrawn from the container 8 the piston of tilting cylinder 30 is radially extended, moving slide plate 25 and radial bearing 22 back to their radially outermost position and returning the container 8 to a substantially vertical position. This action also unlocks the slide plate 25 from safety ring 31 to allow rotation of the magazine 7 about a substantially vertical axis to bring the next length of casing 9 into a position to be tilted.

Referring now to FIGS. 10 and 11 the apparatus 6 has means to accommodate lengths of casing 9 of different diameters. This means comprises radially larger clamping bars 17 for smaller diameter lengths of casing 9 (FIG. 11), and radially smaller clamping bars 17 for larger diameter lengths of casing (FIG. 10).

Means (not shown) may be provided to allow the tilt angle to be adjusted. These means may comprise: setscrews mounted, for example, on the carrier column 24 to inhibit radial movement of a container 8, or on the tilting cylinder 30 to inhibit radial movement of the slide plate 25. These set-screws may be manually or automatically controlled.

It is envisaged that the magazine 7 may comprise any number of containers 8, arranged in any practical way, and that any combination, or all of containers 18 maybe rotatably mounted for simultaneous tilting.

The means to accommodate lengths of casing 9 of various diameters may comprise at least two sets of hydraulic clamping cylinders 15 along the guiding bars 17 so that said guiding bars 17 may be retracted or extended by suitable means such as hydraulic cylinders, into abutment with the length of casing 9 to removably retain the length of casing 9 within the container 8.

Our observations suggest that the provision of this apparatus should make a significant saving in the overall time required to run casing.

Whilst the present invention was primarily developed for running casing it is contemplated that it will also be useful for running other tubular members, for example drill pipe and work strings, the latter usually requiring a fast reliable supply of tubular members. Whilst the preferred embodiment has been described in the context of providing tubulars to a wellbore, the apparatus could equally be used for the temporary storage of tubulars being withdrawn from a well.

If desired the entire magazine may be mounted for tilting movement about a vertical axis.

Whilst the magazine could be adapted to hold any number of tubulars it is anticipated that it will typically only hold a relatively small number of tubulars for example 4 to 16 stands, with 4 to 8 stands being recommended.

What is claimed is:

1. An apparatus for running a tubular, which apparatus is positioned in close proximity to a well center between the well centre and a pipe storage area of a drilling platform having associated therewith a pipe storage area and pipe handling equipment, the apparatus comprising a base and a magazine which hold a plurality of tubulars and which is rotatably mounted on said base, characterized in that said apparatus is operably disposed between the pipe storage area and the well center so that the magazine is reloaded in the proximity of said well center by the pipe handling equipment while a tubular is being dispensed from the magazine.

2. An apparatus as claimed in claim 1 characterized in that said apparatus has means to angle at least one of said tubulars outwardly when said apparatus is in use.

3. An apparatus as claimed in claim 2 wherein said magazine is provided with separate and distinct containers each of which can accommodate a tubular and each container independently pivotable of the other containers.

4. An apparatus as claimed in claim 3 wherein said separate and distinct containers are each mounted on a carrier column which is rotatably mounted on said base.

5. An apparatus as claimed in claim 2 wherein said means to angle at least one of said tubulars can angle a tubular outwardly only when said tubular is in a certain position.

6. An apparatus as claimed in claim 5 wherein said means is located in said base.

7. An apparatus as claimed in claim 6 wherein said means comprises a cylinder and a slide plate, the arrangement being such that, upon movement of said cylinder, said slide plate moves radially inwardly to pivot said container.

8. An apparatus as claimed in claim 7 including a guide plate for guiding said containers as said magazine is rotated.

9. An apparatus as claimed in claim 8 wherein said slide plate, in its radially outermost position, is substantially aligned with said guide plate.

10. An apparatus as claimed in claim 1 further comprising a safety ring.

11. An apparatus as claimed in claim 10 wherein said safety ring has a break therein which accommodates said slide plate upon said movement of said cylinder and inhibits rotation of said magazine relative to said base.

12. An apparatus as claimed in claim 3 wherein said separate and distinct containers have means to accommodate tubulars of different diameters.

13. An apparatus as claimed in claim 12 wherein said means to accommodate tubulars of different diameters comprises one or more clamping bars movably mounted on pistons of one or more hydraulic clamping cylinders.

14. An apparatus as claimed in claim 13 wherein at least one of said containers is provided with a hydraulic cylinder which is connected to the one or more hydraulic clamping cylinders associated with said container, the arrangement being such that, in use, when a tubular bears on said hydraulic cylinder said clamping bar is urged against said tubular.

15. A drilling rig having a drilling platform having a hole to allow casing to be lowered therethrough, characterized in that said drilling rig is provided with an apparatus as claimed in claim 1.

16. A drilling rig as claimed in claim 15 including a storage area for storing tubulars.

17. A drilling rig as claimed in claim 16 wherein said magazine lies between the point of transfer of the tubulars from the storage area and the hole.

18. A method for running tubulars using an apparatus as claimed in claim 1 characterized in that said method comprises the steps of repeatedly dispensing tubulars from said magazine and replenishing said magazine while said apparatus remains in close proximity to said well center.

19. A method according to claim 18 wherein said tubulars are dispensed to a string of tubulars being run into a wellbore.

20. A method according to claim 18 wherein said tubulars are dispensed to a tubular storage area.

* * * * *